US005744182A

United States Patent [19]

Andersson et al.

[11] Patent Number: 5,744,182

[45] Date of Patent: Apr. 28, 1998

[54] AROMATISATION PROCESS USED IN FOOD PACKAGING

[75] Inventors: Bo Andersson, Oxie, Sweden; Dominique Villot, Lausanne, Switzerland

[73] Assignee: Nestec S.A., Vevey, Switzerland

[21] Appl. No.: 640,388

[22] Filed: Apr. 29, 1996

[30] Foreign Application Priority Data

May 4, 1995 [EP] European Pat. Off. ..... 95106702

[51] Int. Cl.[6] ..... A23L 3/3418

[52] U.S. Cl. ..... 426/316; 53/512; 99/468; 141/64; 141/70; 426/386; 426/392; 426/574

[58] Field of Search ..... 426/106, 112, 426/129, 312, 316, 386, 387, 392, 397, 410, 574, 665; 99/467, 468; 53/512, 514; 141/63, 64, 69, 70

[56] References Cited

U.S. PATENT DOCUMENTS

| | | | |
|---|---|---|---|
| 2,333,898 | 11/1943 | Stevenson et al. | 141/70 |
| 3,021,218 | 2/1962 | Clinton et al. | 426/386 |
| 3,039,882 | 6/1962 | Clinton et al. | 426/397 |
| 3,415,665 | 12/1968 | Hussman | 426/387 |
| 4,335,149 | 6/1982 | Stipp | 426/386 |
| 5,043,177 | 8/1991 | Chimel et al. | 426/387 |
| 5,087,468 | 2/1992 | Schulmeyr | 426/386 |

FOREIGN PATENT DOCUMENTS 1 206 047 9/1970 United Kingdom .

*Primary Examiner*—Joseph W. Drodge
*Attorney, Agent, or Firm*—Pennie & Edmonds

[57] ABSTRACT

A process for introducing an aroma into the headspace of a package containing a food product during the gas packaging of the food product which comprises introducing a modified atmosphere into the headspace, and introducing a food acceptable aroma dissolved in a liquid food acceptable gas under pressure into the headspace of the package.

17 Claims, 2 Drawing Sheets

AROMATISATION PROCESS USED IN FOOD PACKAGING

TECHNICAL FIELD

1. Background of the Invention

The present invention relates to a process and device for introducing an aroma into the headspace of a package containing a food product so that, on opening the package, the consumer will smell the aroma.

In some cases it would be desirable to introduce an aroma or fragrance into the headspace of a food package in order to increase the smell of freshness and to stress the uniqueness of the food product so that, on opening the package, the consumer's appetite will be whetted on smelling the aroma or fragrance.

2. Background Art

A system comprising an aromatised gas has been developed by BOC for aromatising large rooms which are used for seminars or fairs, etc. However, we have surprisingly found that an aromatised gas may be used for introducing an aroma into the headspace of a food package to impart a desirable aroma and increase the smell of freshness on opening the package.

SUMMARY OF THE INVENTION

According to the present invention there is provided a process for introducing an aroma into the headspace of a package containing a food product during the gas packaging of the food product which comprises introducing a modified atmosphere into the headspace, and introducing a food acceptable aroma dissolved in a liquid food acceptable gas under pressure (a normally gaseous substance that has been pressurized to become liquid) into the headspace of the package.

DETAILED DESCRIPTION OF THE INVENTION

The process of the present invention may be carried out using any commercially available gas packaging machines, e.g. automatic, semi-automatic or manual vacuum/modified atmosphere packaging machines (Multivac, Tiromat, Dixie Union, etc.), automatic or semi-automatic form-fill-seal machines (horizontal or vertical), or automatic or manual pouch packaging machines.

The food product may advantageously be a chilled product, e.g. charcuterie, packed in a modified atmosphere, for instance in a pouch or it may be a product suitable for ambient storage, e.g. a confectionery product such as biscuits.

The introduction of the modified atmosphere into the headspace may be accomplished by firstly evacuating the air from the package followed by introducing the modified atmosphere. Evacuating air from the package is accomplished by pulling a vacuum which is a conventional process as is the introduction of the modified atmosphere which usually consists of carbon dioxide or nitrogen or a mixture thereof, e.g. 20% $CO_2$ and 80% $N_2$. Alternatively, the modified atmosphere may be introduced by gas flushing which causes the air in the package to be replaced by the modified atmosphere.

The food acceptable aroma is preferably of natural origin, is volatile and is preferably not substantially absorbed by the food product. Advantageously, the fragrance of the aroma is similar to the fragrance of the food product in the package, e.g. a meaty fragrance for a meat product such as charcuterie. The aroma should be soluble in the liquid food acceptable gas. The food acceptable gas may be, for example, carbon dioxide or nitrogen.

Preferably, the food acceptable aroma is dissolved in a food acceptable organic solvent before it is dissolved in the liquid food acceptable gas. Examples of organic solvents are alcohols such as ethyl alcohol or animal or plant oils, e.g. peanut oil. The amount of aroma dissolved in the solvent may be from 2 to 30%, for instance from 5 to 20% by weight based on the weight of the solution. The liquid food acceptable gas containing the food acceptable aroma is conveniently held in a gas container such as a gas bottle or gas cylinder, for instance, under a pressure which may be at least 20 bars, preferably from 30 to 250 bars and more preferably from 40 to 60 bars. The amount of food acceptable aroma in the food acceptable gas may be from 0.5 to 15%, for instance from 1 to 10%, by weight based on the weight of the gas.

The liquid food acceptable gas containing the food acceptable aroma is advantageously fed through a tube to a spraying nozzle positioned to enable it to spray the aroma into the headspace of the package. The tube may be made of any food acceptable plastic or metal material, e.g. stainless steel or polyvinyl chloride. The spraying nozzle may be a fixed nozzle, e.g. installed on the sealing tool of the packaging machine and sprays the aroma into the headspace just before the package has been sealed, or it may be a movable nozzle such as a lance which, after having sprayed the aroma into the headspace, retracts from the package just before it is sealed.

Advantageously, a valve is situated in the tube to control the distribution of the aroma, the time of opening of the valve being set to allow the required amount of the aroma. The amount of liquid food acceptable gas containing the food acceptable aroma introduced into the headspace is usually from 5 to 40%, for instance from 10 to 30% of the headspace. The amount of liquid food acceptable aroma introduced into the headspace is usually from 0.5 to 10 milligrams, for instance from 1 to 5 milligrams. The valve is preferably adapted to open and close very quickly, e.g. less than 2 seconds and more usually from 0.1 to 1 second. A suitable type of valve is a solenoid valve. The valve may be integrated on, and controlled from, the packaging machine but, if desired, it may be operated by a separate system. The signal for introducing the aroma may be at the same time or later than the signal for introducing the modified atmosphere.

The liquid food acceptable gas containing the food acceptable aroma may be introduced shortly after or, advantageously, at the same time as the modified atmosphere into the headspace of the package.

Preferably, the liquid food acceptable gas containing the food acceptable aroma is introduced separately from the modified atmosphere into the headspace of the package.

The present invention also provides an apparatus for introducing an aroma into the headspace of a package containing a food product during the gas packaging of the food product which comprises means for introducing a modified atmosphere into the headspace, and means for introducing a food acceptable aroma dissolved in a liquid food acceptable gas under pressure into the headspace of the package.

The present invention also provides a device for introducing a food acceptable aroma into the headspace of the package during the gas packaging of the food product which comprises a tube one end of which is provided with a spraying nozzle adapted to spray aroma into the headspace of the package and the opposite end adapted to be connected to a supply of the food acceptable aroma dissolved in liquid food acceptable gas under pressure, and a valve situated in the tube to control the distribution of the aroma, the time of opening of the valve being set to correspond to the required amount of the aroma to be introduced into the headspace.

The present invention will now be further illustrated by way of example only with reference to the accompanying drawings.

DETAILED DESCRIPTION OF THE PREFERRED EMBODIMENTS

Figure 1:
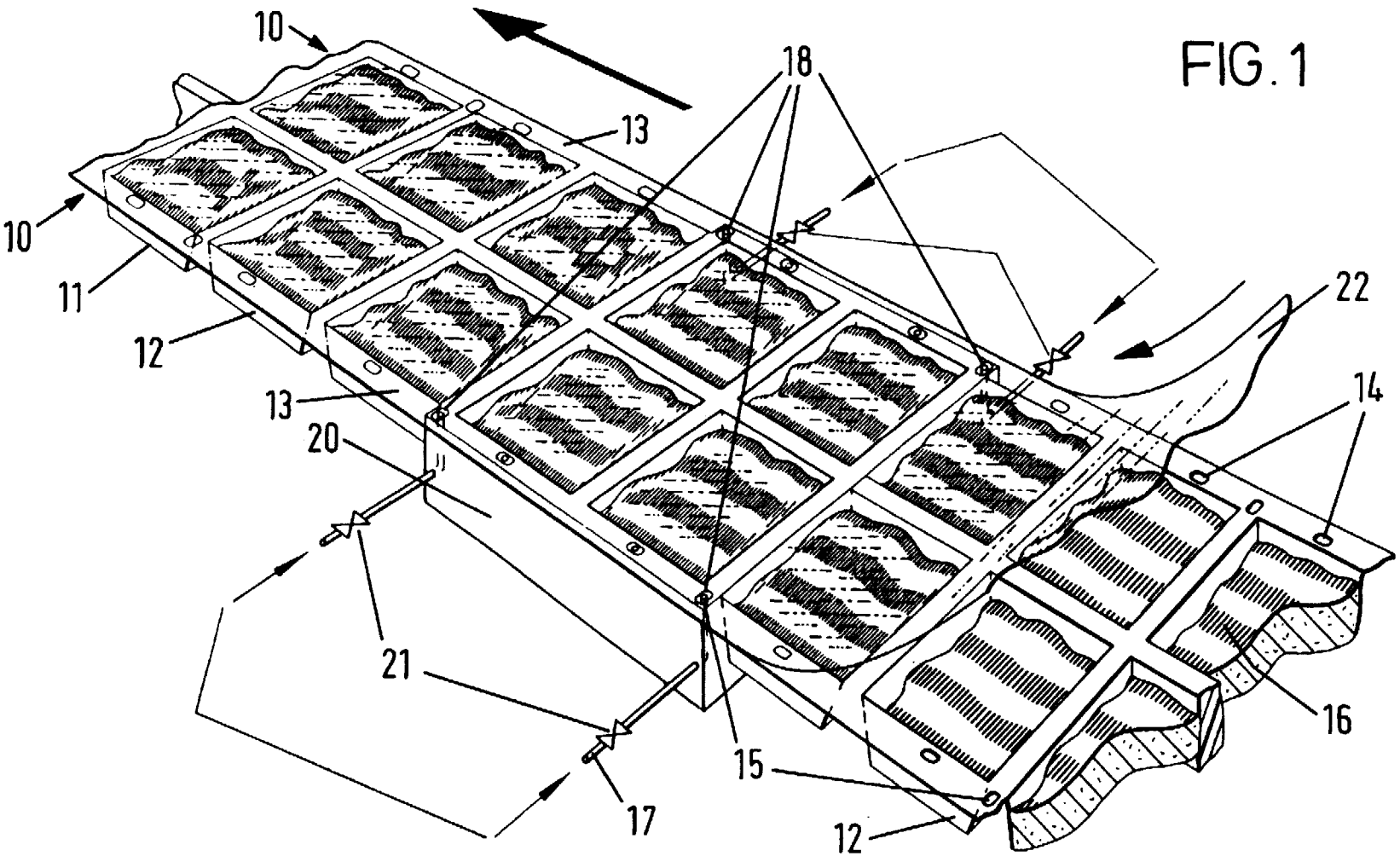
FIG. 1 is a perspective view of aroma being introduced into filled trays at the sealing station using fixed nozzles.

Referring to the drawings, each package comprises a bottom web in the form of a tray 10 having a bottom 11, side walls 12 and a continuous flange 13 extending laterally from the upper edges of the side walls. The flange 13 is formed with prepunched holes 14 for vacuum and modified atmosphere and prepunched holes 15 for aroma gas. The trays may be constructed of a food acceptable plastic material such as polystyrene or polyvinyl chloride or other materials such as cardboard or aluminium foil. The trays are filled with slices of cooked ham 16 and are transported on a conveyor means (not shown) adapted to travel intermittently.

Stainless steel tubes 17 connected at one end to a gas bottle containing a meat-flavored food acceptable aroma dissolved in liquid carbon dioxide under a pressure of 50 bars (not shown) are provided with fixed nozzles 18 (FIG. 1) and movable nozzles 19 (FIG. 2) attached to a sealing station 20 which forms part of a Multivac gas packaging machine (not shown). Solenoid valves 21 are positioned along the lengths of the tubes 17 and are controlled by the packaging machine. A top web 22 made of a flexible plastic material is shown sealed to the flange 13 of some of the trays.

In operation, the filled trays 10 arranged in two rows are conveyed intermittently in the direction of the arrow to the sealing station 20 where a group of four (two rows of two) stop.

In the embodiment shown in FIG. 1, just before the top web 22 is sealed to the flange 13, a vacuum is pulled through the prepunched holes 14 to evacuate air in the headspace. Simultaneously, introduced into the headspace is the combination of a modified atmosphere consisting of 20% $CO_2$ and 80% $N_2$ through the prepunched holes 14 and aroma gas from the gas bottles via the tubes 17 and fixed nozzles 18 through the prepunched holes 15 controlled by a signal from the solenoid valves 21. Afterwards, the top web 22 is sealed to the flange 13.

Figure 2:
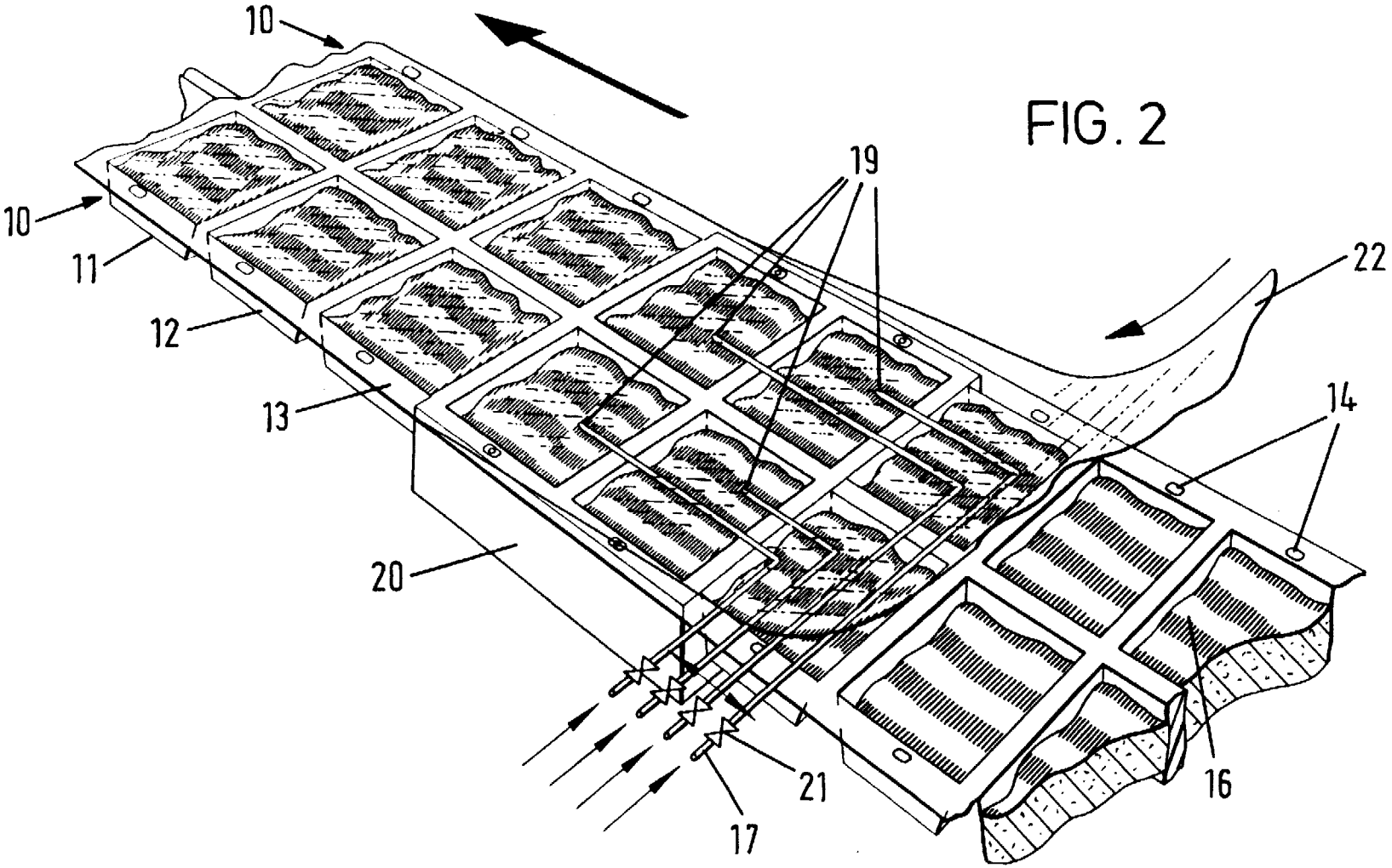
FIG. 2 is a perspective view of aroma being introduced into filled trays at the sealing station using movable nozzles.

In the embodiment shown in FIG. 2, just before the top web 22 is sealed to the flange 13, a vacuum is pulled through the prepunched holes 14 to evacuate air in the headspace. Simultaneously, introduced into the headspace is the combination of a modified atmosphere consisting of 20% $CO_2$ and 80% $N_2$ through the prepunched holes 14 and aroma gas from the gas bottles via the tubes 17 and movable nozzles 19 which are withdrawn from the headspace just before the top web 22 is sealed to the flange 13.

Afterwards, the sealed trays are transported away from the sealing station and the following group of four trays stop at the sealing station to be treated in a similar manner.

We claim:

1. A process for introducing an aroma into the headspace of a package containing a food product during the gas packaging of the food product which comprises introducing a modified atmosphere into the headspace, and introducing a food acceptable aroma dissolved in a liquid food acceptable gas under pressure into the headspace of the package.

2. A process according to claim 1 wherein the food product is a chilled charcuterie product.

3. A process according to claim 1 wherein the introduction of the modified atmosphere into the headspace is accomplished by firstly evacuating air from the package followed by introducing the modified atmosphere.

4. A process according to claim 1 wherein the introduction of the modified atmosphere into the headspace is accomplished by gas flushing which causes air in the package to be replaced by the modified atmosphere.

5. A process according to claim 1 wherein the food acceptable gas is carbon dioxide.

6. A process according to claim 1 wherein the food acceptable aroma is volatile and is not substantially absorbed by the food product.

7. A process according to claim 5 wherein the food acceptable aroma is dissolved in a food acceptable organic solvent before it is dissolved in the liquid carbon dioxide.

8. A process according to claim 1 wherein the liquid food acceptable gas containing the food acceptable aroma is under a pressure of at least 20 bars.

9. A process according to claim 1 wherein the liquid food acceptable gas containing the food acceptable aroma is held under a pressure of from 40 to 60 bars.

10. A process according to claim 1 wherein the liquid food acceptable gas containing the food acceptable aroma is fed through a tube to a spraying nozzle positioned to enable it to spray the aroma into the headspace of the package.

11. A process according to claim 10 wherein the spraying nozzle is a fixed nozzle installed on the sealing tool of the packaging machine and sprays the aroma into the headspace just before the package has been sealed.

12. A process according to claim 10 wherein the spraying nozzle is a movable nozzle which, after having sprayed the aroma into the headspace, retracts from the package just before it is sealed.

13. A process according to claim 10 wherein a valve is situated in the tube to control the distribution of the aroma, the time of opening of the valve being set to correspond to the required amount of the aroma.

14. A process according to claim 13 wherein the valve is integrated on, and controlled from, the packaging machine.

15. A process according to claim 1 wherein the liquid food acceptable gas containing the food acceptable aroma is introduced at the same time as the modified atmosphere into the headspace of the package.

16. A process according to claim 1 wherein the liquid food acceptable gas containing the food acceptable aroma is introduced separately from the modified atmosphere into the headspace of the package.

17. A device for introducing a food acceptable aroma into the headspace of a package during gas packaging of a food product therein, which device comprises a supply of a food acceptable aroma dissolved in a liquid food acceptable gas under pressure, a tube one end of which is provided with a nozzle for spraying the food acceptable aroma into the headspace of the package and the opposite end of which is connected to the aroma supply, a valve situated in the tube to control the distribution of the aroma, and a controller which opens the valve for a time which allows a required amount of the aroma to be introduced into the headspace of the package.

* * * * *